US008764522B2

(12) United States Patent
Pascoe

(10) Patent No.: US 8,764,522 B2
(45) Date of Patent: Jul. 1, 2014

(54) DENTAL SHARPENING DEVICE

(76) Inventor: Richard Pascoe, Traverse City, MI (US)

( * ) Notice: Subject to any disclaimer, the term of this patent is extended or adjusted under 35 U.S.C. 154(b) by 288 days.

(21) Appl. No.: 13/097,733

(22) Filed: Apr. 29, 2011

(65) Prior Publication Data

US 2011/0269379 A1 Nov. 3, 2011

Related U.S. Application Data

(60) Provisional application No. 61/329,199, filed on Apr. 29, 2010.

(51) Int. Cl.
*B24D 15/06* (2006.01)

(52) U.S. Cl.
USPC ..... 451/540; 451/45

(58) Field of Classification Search
USPC ..... 451/45, 540, 555, 523, 524; 76/82; D8/91
IPC ..... B24D 15/02,15/06, 15/08
See application file for complete search history.

(56) References Cited

U.S. PATENT DOCUMENTS 618,880 A * 2/1899 Humphrey ..... 451/552
D53,645 S * 7/1919 Taylor ..... D8/91
1,520,488 A * 12/1924 Tone ..... 451/540
1,976,070 A * 10/1934 Hermann ..... 51/308
2,324,025 A * 7/1943 Revell ..... 451/164
2,442,088 A * 5/1948 Kreutzer ..... 451/558
2,865,147 A * 12/1958 Grandemange ..... 451/540
D219,726 S * 1/1971 Van Horn ..... D8/91
3,894,362 A * 7/1975 Graves ..... 451/552
4,231,194 A * 11/1980 Glesser ..... 451/552
4,509,268 A * 4/1985 Marquam et al. ..... 33/201
D285,042 S * 8/1986 Sparks ..... D8/91
4,696,129 A * 9/1987 Roberts ..... 451/555
D296,518 S * 7/1988 Sadler ..... D8/91
4,838,899 A * 6/1989 Bifuk ..... 51/293
D337,253 S * 7/1993 Glesser ..... D8/91
D340,178 S * 10/1993 Kashani ..... D8/91
5,487,693 A * 1/1996 Prusaitis et al. ..... 451/45
5,520,574 A 5/1996 Wilson
D375,441 S * 11/1996 McCoy et al. ..... D8/91
5,584,691 A * 12/1996 Domenella ..... 433/143
5,667,434 A * 9/1997 Prusaitis et al. ..... 451/552

(Continued)

FOREIGN PATENT DOCUMENTS

DE 19943548 A1 * 3/2001
GB 1512733 A * 6/1978

*Primary Examiner* — Joseph J Hail
*Assistant Examiner* — Joel Crandall
(74) *Attorney, Agent, or Firm* — Douglas S. Bishop

(57) ABSTRACT

A one-piece hand-held sharpening device for dental instruments. The device is a sharpening stone having a continuous abrasive surface, with a uniform overall thickness, and generally corresponding flat longitudinally rectangular top face and bottom face surfaces. One side surface contains at least two longitudinal radius grooves and the opposite side face has rounded edges where it abuts the top and bottom surfaces. From either side view, it presents as an isosceles trapezoid with the top and bottom surfaces in parallel, both end surfaces with equal dimensions, and extending at equal angles from the end of the bottom surface to the end of the top surface. During sharpening, the upper end surface is aligned in parallel with a horizontal work surface. In other sharpening operations, each of the radius grooves allows proper sharpening of a different sized curette toe and the rounded edges permit sharpening of instruments with concave surfaces.

14 Claims, 3 Drawing Sheets

(56) References Cited

U.S. PATENT DOCUMENTS

| | | | | | |
|---|---|---|---|---|---|
| D401,129 | S | * | 11/1998 | Glesser | D8/91 |
| 5,928,069 | A | * | 7/1999 | Glesser | 451/523 |
| 6,074,293 | A | | 6/2000 | Bleier | |
| 6,146,257 | A | | 11/2000 | Himeno et al. | |
| 6,251,003 | B1 | * | 6/2001 | LeVine | 451/557 |
| 6,361,408 | B1 | | 3/2002 | Bleier | |
| 6,595,837 | B2 | * | 7/2003 | Raklovits et al. | 451/321 |
| 6,824,457 | B2 | * | 11/2004 | Himeno et al. | 451/364 |
| 6,852,014 | B1 | | 2/2005 | Gleason | |
| 6,949,018 | B2 | | 9/2005 | Bleier | |
| 6,971,949 | B2 | | 12/2005 | Gleason | |
| 7,186,169 | B2 | | 3/2007 | Kawata | |
| 8,070,563 | B2 | * | 12/2011 | Viscomi et al. | 451/451 |
| 2004/0105959 | A1 | * | 6/2004 | Pearsall et al. | 428/143 |
| 2009/0203301 | A1 | | 8/2009 | Viscomi et al. | |

* cited by examiner

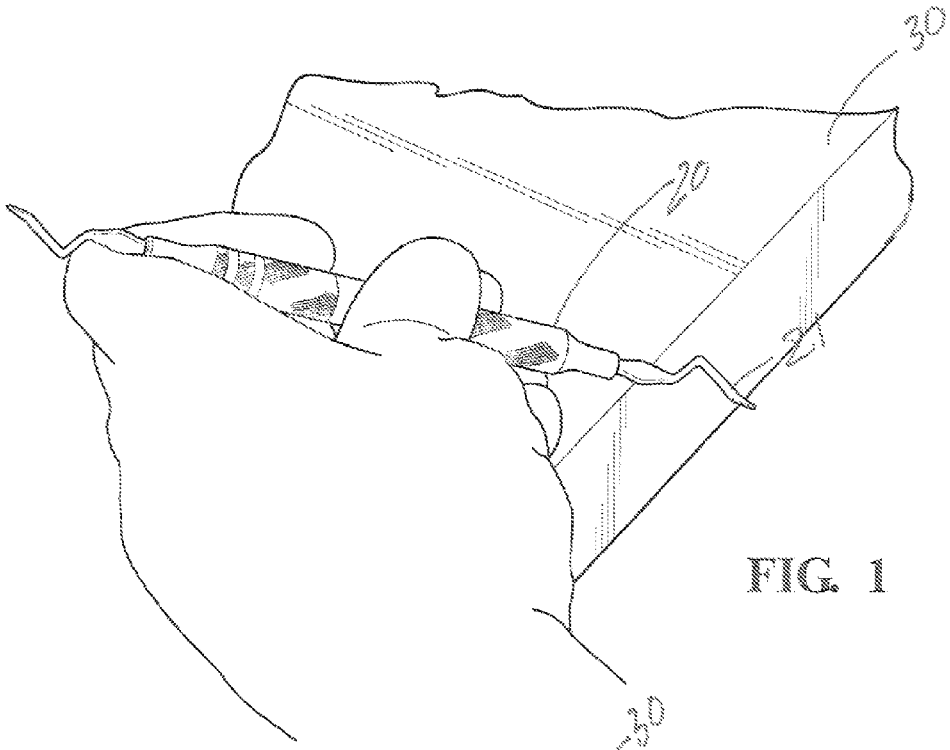
FIG. 1
FIG. 2
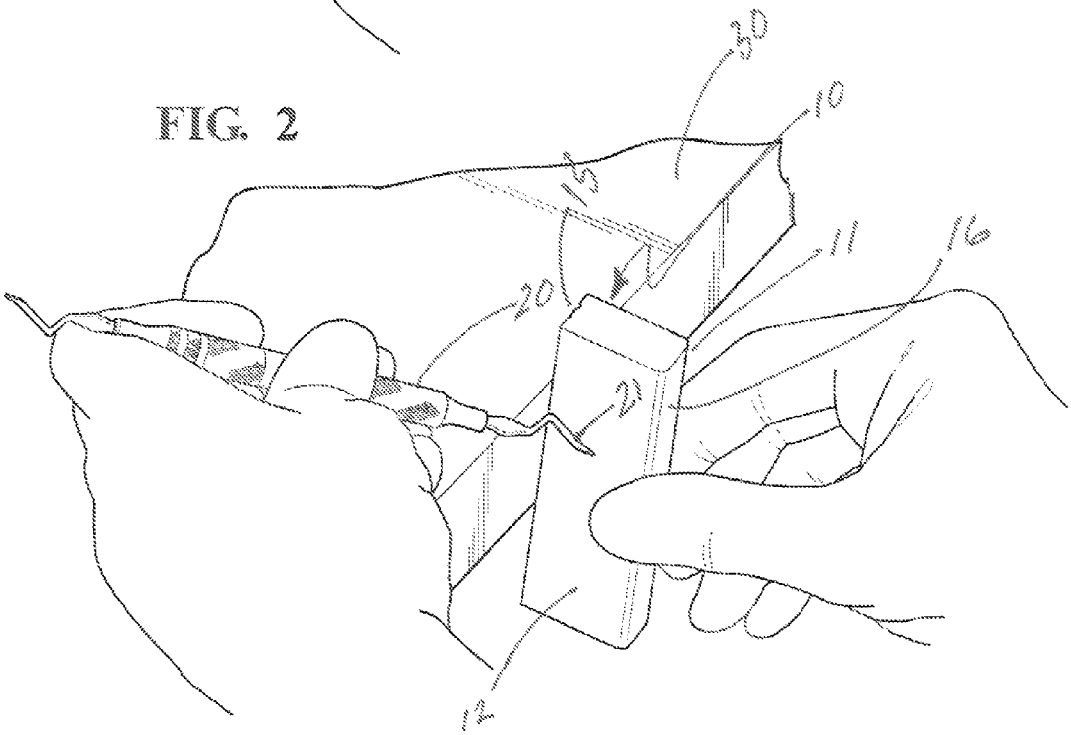

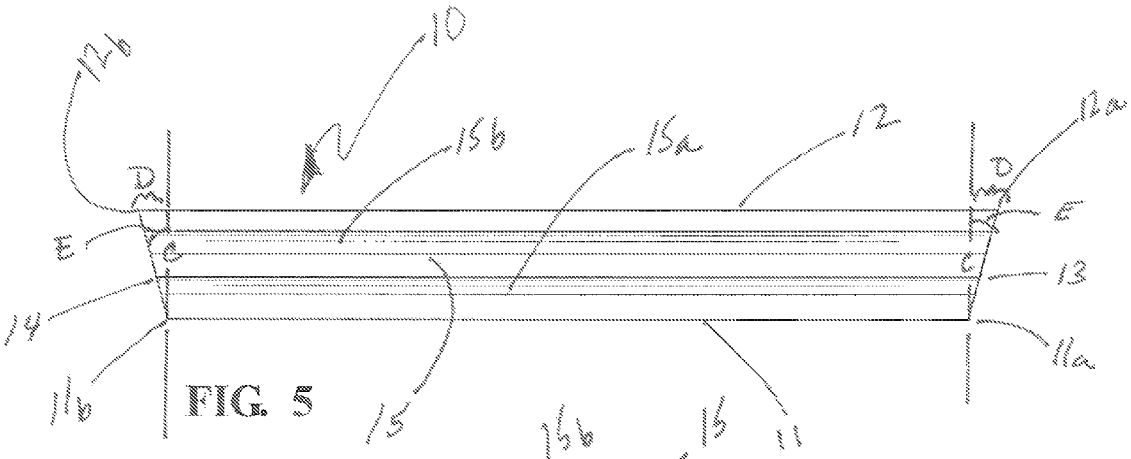
FIG. 5
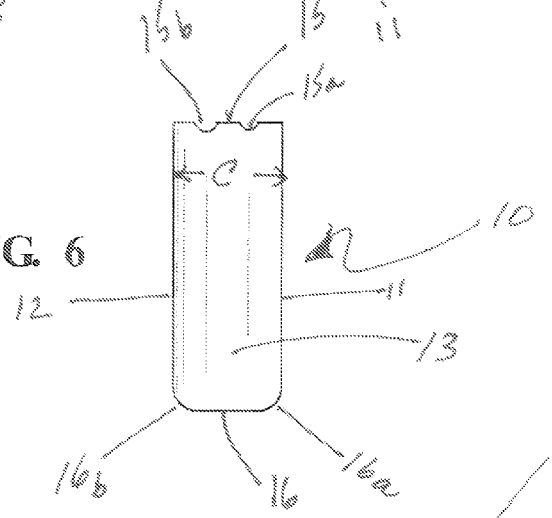
FIG. 6
FIG. 7
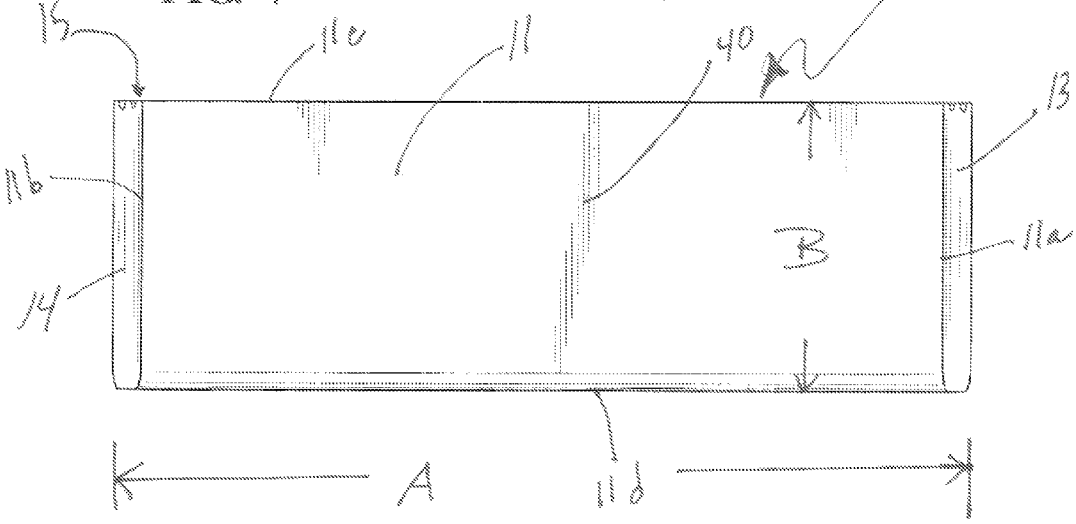

DENTAL SHARPENING DEVICE

CROSS-REFERENCE TO RELATED APPLICATIONS

The present application claims the priority of U.S. Provisional Patent Application Ser. No. 61/329,199, filed Apr. 29, 2010.

FIELD OF THE INVENTION

The present invention is generally concerned with providing a sharpening device for dental instruments. More specifically, the present invention discloses a one-piece hand-held sharpening device for dental instruments, which provides angled ends for alignment with a work surface, to aid in correct alignment of the instrument during the sharpening process. Additional features are provided for sharpening instruments having rounded toe features, and instruments having concave surfaces.

BACKGROUND OF THE INVENTION

The concept of providing a one piece sharpening device with a continuous abrasive surface is known. U.S. Pat. No. 5,520,374 to Wilson discloses a generally rectangular and elongated wedge-shaped ceramic stone. Likewise, the prior art, including Wilson, discloses the use of a semi-circular groove, as shown in cross-section, extending lengthwise across the face of a device. Other examples of groove features, as found in the prior art, include U.S. Pat. Nos. 6,074,293, 6,361,408 and 6,949,018 to Bleir.

Other references in the prior art are directed to providing a broad, flat sharpening surface positioned at particular angle from the work surface. U.S. Pat. No. 6,146,257 to Himeno, et al, attempts to address this requirement by providing a complex combination of a base plate, guide member, and manually operated positioning device, to hold a flat sharpening surface at a designated angle, on a fixed, flat work surface. U.S. Pat. No. 6,971,949 attempts to address this by providing a separate sharpening "guide" to be placed upon an abrasive surface and the dental instrument moved in cooperation with the various angle options provided.

Various dental instruments require different parameters relative to an abrasive surface for sharpening them. Common errors in sharpening include the creation of an improper bevel as well as sharpening the toe of a curette, which is intended to remain rounded, to a point.

Other dental instruments have concave surfaces which are difficult to sharpen on a flat surface and in best practice require a rounded edge on the abrasive sharpening surface.

While dental instruments may be routinely sharpened, there are occasions when they must be sharpened at chair-side and with minimal disruption of an ongoing procedure.

A common technique, long taught in dental schools, for using a hand-held sharpener for sharpening, requires holding the instrument to be sharpened in one hand, with its face parallel to the work surface, and the sharpening stone in the other hand. The sharpening stone is positioned against the instrument so that the sharpening face is angled at approximately 15° from the generally horizontal work surface. The practitioner must maintain this angle during the sharpening process, to properly sharpen the instrument.

With current hand-held sharpeners, finding and maintaining the correct, optimal angle is often a matter of educated guesswork, unless a line or other reference guide is provided or imposed upon the edge of the work surface. As stated, prior art attempts to address this issue have required significant additional device elements, and have required unwarranted and time consuming complexity as compared to the use of a hand-held, one piece sharpener. The prior art as well, has in general failed to combine the sharpening requirements for various dental instruments, as referenced above, in a simple, one-piece hand-held sharpener.

The present invention addresses the short-comings of the prior art by providing a concise, one-piece, sharpening device designed to be used for routine maintenance, as well as chair-side during procedures, as necessary, and which allows a practitioner to accurately and easily gauge and maintain the correct sharpening angle, together with multiple-sized sharpening grooves, as well as rounded edges for concave instrument surfaces.

SUMMARY OF THE INVENTION

The current invention is a unique, single piece dental instrument sharpening device. The invention is designed to substantially reduce, if not eliminate, the most common errors made by practitioners when attempting to hand sharpen any dental curette or scaler. The novelty of the invention lies in its one piece construction which comprises a dental sharpening device, with a continuous abrasive coating, easily held in one hand, which allows a practitioner, either as a matter of routine, or if necessary, even during a procedure, to easily, with one instrument, alternatively, sharpen instruments which require the sharpening stone to be held at a precise angle, to sharpen instruments with rounded edges, through abrasive grooves, and to sharpen instruments with concave edges. The present invention accomplishes these objectives by providing a device which does not require external guides or instruments, may be held at the edge of a work surface, and does not require a base beneath it, to allow free movement up and down, by the practitioner, in any of the applications.

The device is a sharpening stone, with a continuous overall abrasive surface. It has a flat generally rectangular first sharpening surface, or top, and a corresponding slightly longer generally rectangular, flat bottom sharpening surface, in parallel, with the top surface. The distance between the top and bottom surfaces is generally uniform. The device is further generally elongated between its two end surfaces. The two end surfaces are both flat, and both are at a uniform angle, and length, between the upper and lower flat surfaces. When viewed from the side, the dimensions of the device form an elongated isosceles trapezoid with the edge of each end surface forming an equal angle with the edge of the bottom flat surface.

The angle formed is roughly a 15° angle, in the primary embodiment, and, in practice, would be within a range of no less than 10° and no more than 20. However, for standard dental instrument sharpening purposes, the optimum angle would be 15°.

When held by a practitioner, placing one of the sides of the invention proximate the edge of a table or other substantially horizontal workplace, uppermost angled edge is maintained approximately in parallel with the substantially horizontal work surface. The angled edge alignment makes it substantially easier for the practitioner conducting the sharpening exercise, to maintain the desired angle between the stone and the instrument being sharpened. Conformity of the edges in opposite direction, in isosceles triangular relationship, allows an instrument to be sharpened from the reverse side, at the same angle.

On one of the narrower sides of the device, at least two longitudinal grooves, extending the length of the device, are provided in parallel. Each of the grooves provided is of a different size radial/half circular dimension, in cross-section, to accommodate different sized instruments. Using these grooves, the practitioner is able to sharpen instruments which have rounded tips, without sharpening them to a point, a common problem in sharpening dental instruments.

Finally, the opposite narrower side of the invention has two rounded edges, where the side meets the upper and lower flat face sharpening surfaces. These rounded edges are used by the practitioner to sharpen instruments with concave surfaces.

The number of radial grooves provided in one side of the device is optimally at least two, but is not limited to that number.

The optimum angle 15° with the caveat being that the angle could be any between 10° and 20°, with the most important feature being both end surface angles equally angled outwardly at each end of the device.

With regard to the radial/semi-circular grooves, which run the length of the sharpening device, the clinician/practitioner need only drag the instrument's toe through the channel with a few strokes to uniformly sharpen it, yet maintain it's rounded shape.

The invention is not limited by the type of abrasive surface, with the primary novelty of the invention being in a particular shape of the uniform angled end surfaces in relation to the opposing flat top and bottom surfaces, as well as that primary feature in combination with the multiple differentially sized longitudinal grooves, and the rounded corners, for concave instruments. The abrasive surfaces available may include, without being limited to, aluminum oxide composition, a silicone carbide composition, or diamond dust plate composition, or other grit coating or composition.

Other objects, advantages and novel features of the invention will be set forth and will become apparent in the Detailed Description which follows, with references to the accompanying drawings.

BRIEF DESCRIPTION OF THE DRAWINGS

FIG. 1 shows a typical dental instrument being held in proximity to a substantially horizontal work surface.

FIG. 2 is a perspective view of the device of the current invention being held against the edge of a substantially horizontal work surface; the angled edge surface of the device being aligned in parallel with the work surface with an instrument to be sharpened in the other hand.

FIG. 5 is a side view of the device showing the different sized radial grooves of the device and the isosceles trapezoidal alignment of the angled end surfaces.

FIG. 6 is an end view of the device showing the relationship of the radial grooves, the flat top and bottom surfaces and the rounded edges.

FIG. 7 is a top view of the device which shows the flat upper sharpening surface, one rounded edge, the alignment of the radial grooves and the isosceles trapezoidal relationship of the two end surfaces.

DETAILED DESCRIPTION OF THE PREFERRED EMBODIMENTS

Figure 3:
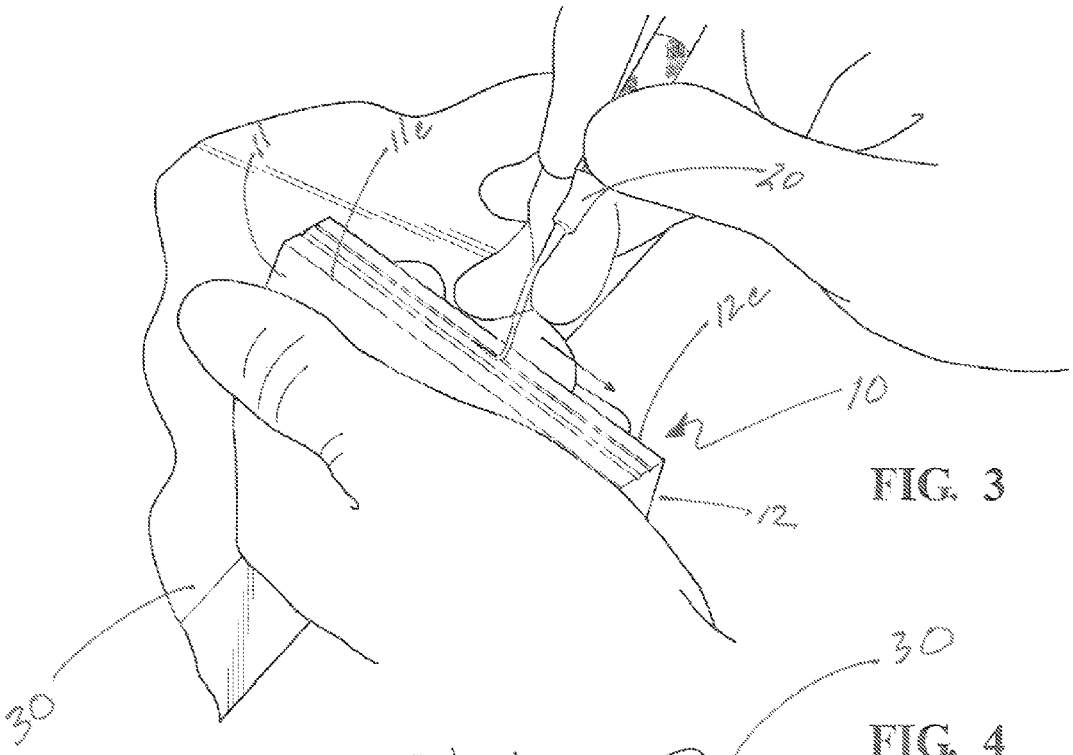
FIG. 3 is a perspective view of the device with edge containing radial grooves being utilized to sharpen an instrument with a rounded tip.

As previously described, the present invention discloses a one-piece hand-held dental sharpening instrument sharpening device 10. Device 10 has a flat (or planar) first sharpening surface 11 and a parallel flat (or planar) second sharpening surface 12. Each of the first and second sharpening surfaces 11 and 12 are substantially rectangular as set forth in FIGS. 2, 4 and 7. As shown in FIGS. 2, 3, 4, and 7, device 10 has a length dimension A substantially greater than its width dimension B. First flat surface 11 has a first end 11*a* and a parallel second end 11*b* and a first side 11*c* and a second side 11*d*. Second flat surface 12 has a first end 12*a*, a parallel second end 12*b*, a first side 12*c* and a second side 12*d*.

The device 10 has a uniform thickness C between the flat, perpendicular sharpening surfaces 11 and 12 along the length of first sharpening surface 11 between ends 11*a* and 11*b*. First end 12*a* and second end 12*b* each extend an equal distance D outward from first end 11*a* and second end 11*b*.

Device 10 has two end surfaces—a first end surface 13 and a second end surface 14. The end surfaces 13 and 14 extend between the first ends 11*a* and 12*a*, and the second ends 11*b* and 12*b* of the first planar surface 11 and second planar surface 12, respectively.

As demonstrated by FIG. 5, a side view of the device 10, in outline, displays an exterior dimension of an isosceles trapezoid (an isosceles trapezoid, as that term is herein utilized, is meant to be a trapezoid wherein the two sides which are not parallel have equal lengths, one of the parallel sides is shorter than the other, and the base angles of the trapezoid are equal in measurement), wherein the lengths of end surface 13 and end surface 14 are equal, and the angle formed between end surface 13 and a line perpendicular to sharpening surface 12 and bisecting a point on first end 11*a* is equal to the angle formed between end surface 14 and a line perpendicular to sharpening surface 12 and bisecting a point on second end 11*b*.

The device 10 further has a substantially flat first side 15 which further defines two grooves 15*a* and 15*b*, which, as shown in FIG. 6, are semi-circular in cross-section, and as shown in FIGS. 3 and 5, traverse the length of first side 15 in parallel. Grooves 15*a* and 15*b* are of different sizes to accommodate varying sized instruments. Where a pair of grooves 15*a* and 15*b* are shown, it does not depart from the novelty nor the spirit of the invention to provide a single groove or a plurality in excess of two with further variance in the sizes provided.

Angle E as shown is optimally 15° but may be within a range of 10° to 20° without departing from the novelty or the spirit of the invention, with the primary requirement remaining that angle E be consistent at both ends 13 and 14 of the device 10.

In the preferred embodiment of the invention described, the entire surface of the device 10 has an abrasive texture 40 sufficient to provide a sharpening effect, the abrasive surface resulting from construction of the device from aluminum oxide or silicone carbide composition, providing a diamond dust coating on a base unit of the device 10, or other grit-type material, composition or coating.

As demonstrated by FIGS. 2, 4, 6, and 7, side 16 of device 10 where it contacts first sharpening surface 11 and second sharpening surface 12 has rounded edges 16*a* and 16*b* to accommodate sharpening of concave dental instruments.

FIG. 3 of the device shows a dental instrument 20 being sharpened in one of the parallel grooves 15*a*.

Figure 4:
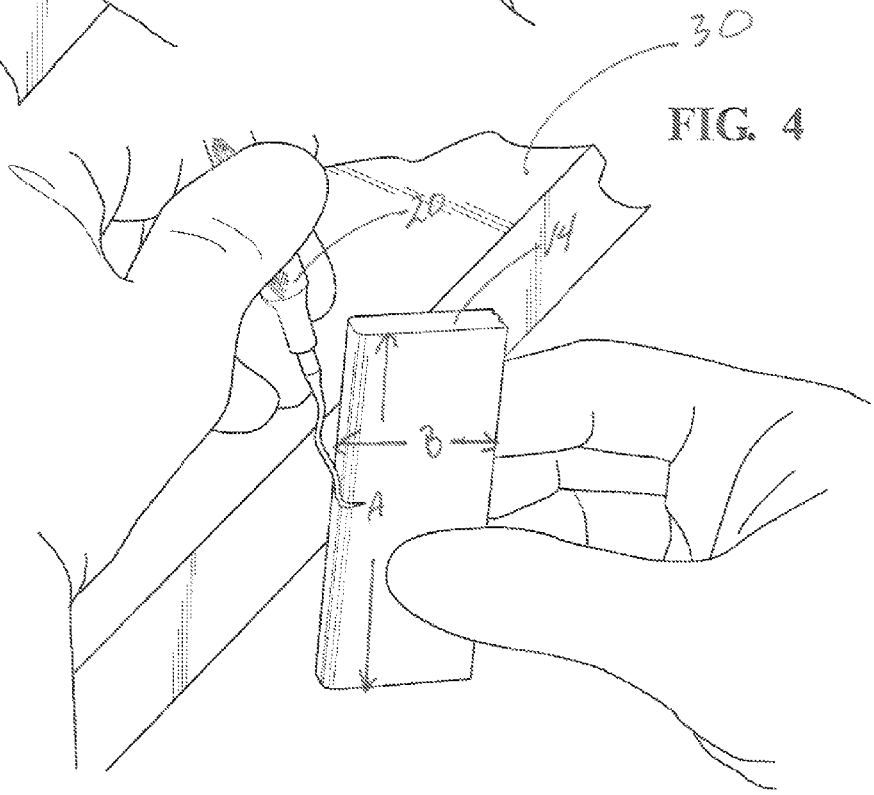
FIG. 4 is a perspective view of the device with one of the rounded edges being used to sharpen an instrument having a concave surface.

FIG. 4 of the device shows a dental instrument 20 with a concave shape, being sharpened on one of the rounded edges 16*a* of the device 10.

FIG. 2 demonstrates utilization of one of the rectangular sharpening surfaces 12 of the device, to sharpen a dental instrument 20 being held against the work surface 30, with its face 21 parallel to the work surface, with the device 10 being aligned, proximate the work surface, with the upper angled surface 14 thereof being held approximately in parallel position with the work surface 30. The device 10 is then moved in alignment with the work surface 30 while maintaining contact with face 21 of instrument 20 and maintaining the parallel position of the angled surface 14 with the work surface 30.

Having described my invention, other and additional and preferred embodiments will become apparent to those skilled in the art to which it pertains, and without deviating from the scope of the appended claims.

I claim:

1. A single piece, hand-held dental instrument sharpening device, further comprising:

a body having a planar sharpening surface and a parallel planar second sharpening surface;

each planar first and second sharpening surface being substantially rectangular with a first end and a parallel second end and a first side and a second side;

a uniform thickness defined by the distance between the first and second sides of the first planar sharpening surface and the second planar sharpening surface between the first end and the second end of the first planar surface;

each of the first and second ends of the second planar sharpening surface extending an equal distance outwardly from the respective first and second ends of the first planar sharpening surface;

a planar first end surface extending between the first ends of the first planar sharpening surface and second planar sharpening surface and a planar second end surface extending between the second ends of the first planar sharpening surface and the second planar sharpening surface, wherein the first and second end surfaces extend from the second planar surface at an equal angle within a range of 10° to 20°;

a first side surface and a second side surface, the exterior dimension of each forming corresponding isosceles trapezoids; and each of said first and second sharpening surfaces having an abrasive surface such that, upon said body adapted to being held by a user in which a selected side surface abuts against a vertical edge of an elevated platform exhibiting a horizontal work surface, an uppermost arrayed of said end surfaces being maintained in an approximately parallel relationship with the horizontal work surface to facilitate sharpening of an instrument tip, an opposite of said end surfaces further facilitating sharpening of the instrument tip from a reverse edge thereof and at an identical angle relative to said body.

2. The invention of claim 1, wherein the equal angle is 15°.

3. The invention of claim 1, wherein said abrasive surface is achieved from selecting from one of an aluminum oxide composition, a silicone carbide composition, or diamond dust plate composition.

4. The invention of claim 1, wherein the corresponding edges of the first planar sharpening surface and second planar sharpening surface which define one of either the first side surface or second side surface are rounded; and said rounded edges, corresponding side surface, and first planar sharpening surface and second planar sharpening surface have a continuous abrasive surface.

5. The invention of claim 4, wherein said abrasive surface is achieved from selecting from one of an aluminum oxide composition, a silicone carbide composition, or diamond dust plate composition.

6. A single piece, hand-held dental instrument sharpening device, further comprising:

a body having a planar first sharpening surface and a parallel planar second sharpening surface;

each planar first and second sharpening surface being substantially rectangular with a first end and a parallel second end and a first side and a second side;

a uniform thickness defined by the distance between the first and second sides of the first planar sharpening surface and the second planar sharpening surface between the first end and the second end of the first planar surface;

each of the first and second ends of the second planar sharpening surface extending an equal distance outwardly from the respective first and second ends of the first planar sharpening surface;

a planar first end surface extending between the first ends of the first planar sharpening surface and second planar sharpening surface and a planar second end surface extending between the second ends of the first planar sharpening surface and the second planar sharpening surface;

a first side surface and a second side surface, the exterior dimension of each forming corresponding isosceles trapezoids, wherein one of either the first side surface or second side surface is substantially planar and perpendicular between the first planar sharpening surface and second sharpening planar surface, and further comprises at least one longitudinal groove, semi-circular in cross-section, between the first and second end surfaces;

and the surface of said side surface and of each said groove having an abrasive surface; and each of said first and second sharpening surfaces having an abrasive surface such that, upon said body adapted to being held by a user in which a selected side surface abuts against a vertical edge of an elevated platform exhibiting a horizontal work surface, an uppermost arrayed of said end surfaces being maintained in an approximately parallel relationship with horizontal work surface to facilitate sharpening of an instrument tip, an opposite of said end surfaces further facilitating sharpening of the instrument tip from a reverse edge thereof and at an identical angle relative to said body.

7. The invention of claim 6, wherein a plurality of said grooves is provided with each groove having a different radial dimension.

8. The invention of claim 7, wherein said abrasive surface is achieved from selecting from one of an aluminum oxide composition, a silicone carbide composition, or diamond dust plate composition.

9. A multi-feature sharpening stone, comprising:

a rectangular shaped body having abrasive surfaces and which, in two dimension, exhibits a greater length and a lesser width, said body in three dimension having a constant thickness between opposite main surfaces and along first and second side surfaces, said body terminating in end surfaces which are angled so as to define an isosceles trapezoidal shape in side profile;

a first of said side surfaces being flat and exhibiting at least one concave groove extending between said angled end surfaces; and a second length extending side surface defining rounded edges with said main surfaces;

said body adapted to being held by a user in which a selected side surface abuts against a vertical edge of an elevated platform exhibiting a horizontal work surface, an uppermost arrayed of said angled end surface being maintained in an approximately parallel relationship with the horizontal work surface to facilitate sharpening of an instrument tip, an opposite of said angled end surfaces further facilitating sharpening of the instrument tip from a reverse edge thereof and at an identical angle relative to said body.

10. A method for sharpening an instrument, comprising:

providing a rectangular shaped body with abrasive surfaces and which, in two dimension, exhibits a greater length and a lesser width;

configuring said body in three dimension to have a constant thickness between opposite main surfaces and along first and second side surface;

angling first and second end surfaces of said body so as to define an isosceles trapezoidal shape in side profile;

holding said body so that a selected side surface abuts against a vertical edge of an elevated platform exhibiting a horizontal work surface; and arraying an uppermost of said angled end surfaces such that it is maintained in an approximately parallel relationship with the horizontal work surface to facilitate sharpening of an instrument tip, the other of said angled end surfaces further facilitating sharpening of the instrument tip from a reverse edge thereof and at an identical angle relative to said body.

11. The method as described in claim 10, further comprising the step of forming at least one concave groove along a first of said side surfaces in extending fashion between said angled end surfaces.

12. The method as described in claim 11, said step of forming at least one concave groove further comprising forming a pair of semi-circular concave grooves exhibiting different sizes for accommodating varying sized instrument tips.

13. The method as described in claim 10, further comprising the step of said first and second end surfaces each extending at an equal angle within a range of 10° to 20° relative to a perpendicular line through each of said main surfaces.

14. The method as described in claim 10, further comprising the step of configuring at least one of said first of said side surfaces to define rounded edges with said main surfaces.

* * * * *